United States Patent [19]

Skakunov

[11] 4,223,797

[45] Sep. 23, 1980

[54] STORAGE TANK

[76] Inventor: Mikhail G. Skakunov, ulitsa Zelenaya, 6, kv. 60, Moskovskoi oblasti, Moscow, U.S.S.R.

[21] Appl. No.: 876,527

[22] Filed: Feb. 9, 1978

[51] Int. Cl.[3] ..... B65D 8/08; B65D 25/24; B65D 90/12

[52] U.S. Cl. ..... 220/5 A; 52/194; 52/248; 220/1 B; 220/18.1; 220/72.1

[58] Field of Search ..... 220/1 B, 5 A, 69, 71, 220/12, 18, 18.1, 70.1; 52/248, 194, 81, 82, 224; 248/317, 346, 350, 310

[56] References Cited

U.S. PATENT DOCUMENTS

| | | | |
|---|---|---|---|
| 1,189,694 | 7/1916 | Janssen et al. | 52/224 |
| 1,193,767 | 8/1916 | Crisell | 52/82 |
| 1,517,006 | 11/1924 | Horton | 220/1 B |
| 2,391,374 | 12/1945 | Wickstrum | 220/1 B |
| 2,487,786 | 11/1949 | Bogle | 220/1 B |
| 2,731,334 | 1/1956 | Wissmiller et al. | 220/1 B |
| 2,874,651 | 2/1959 | Peterson | 52/82 |
| 3,043,465 | 7/1962 | Horner | 220/5 A |

*Primary Examiner*—Allan N. Shoap
*Attorney, Agent, or Firm*—Burgess, Ryan and Wayne

[57] ABSTRACT

A storage tank having a shell in the form of a body of revolution mounted on supporting uprights. The guides equispaced around the external surface of the shell, along its generatrix, accommodate flexible elements whose ends are attached to the tensioning devices located on the top and bottom of the shell. This tank is durable, retains its shape in service and is easily suited for transportation.

4 Claims, 4 Drawing Figures

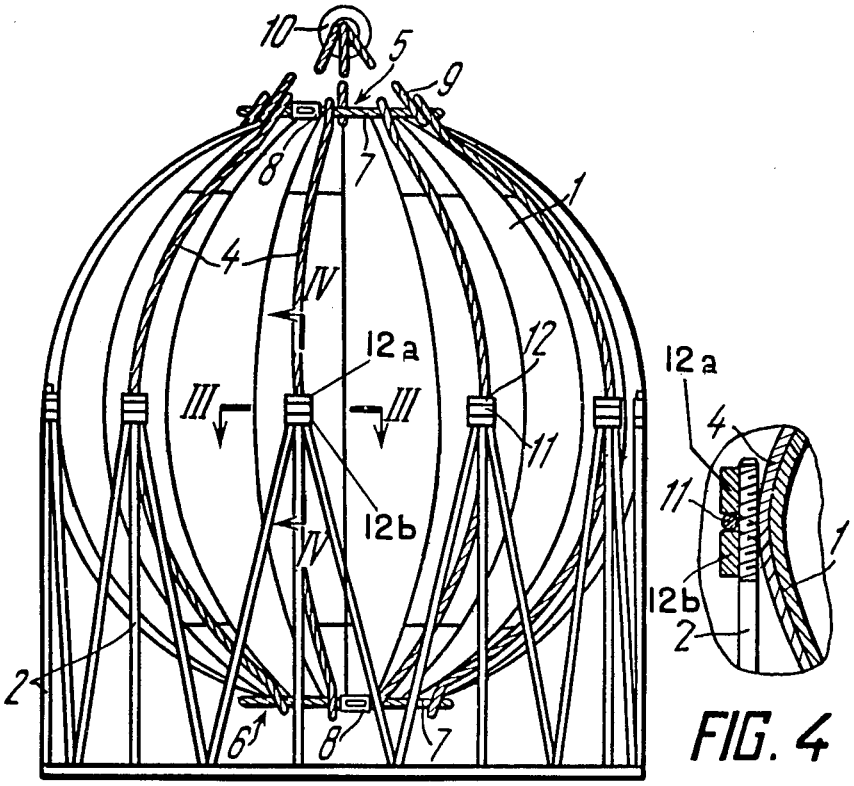
FIG. 4
FIG. 1
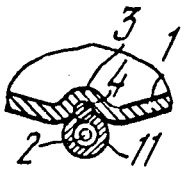
FIG. 3
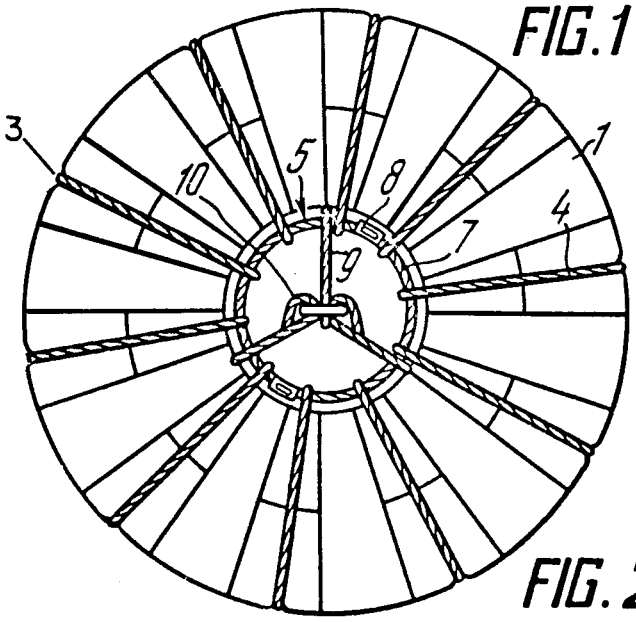
FIG. 2

STORAGE TANK

The present invention relates to containers for storing various materials and more particularly, relates to storage tanks for liquids.

The improvement claimed in this invention can be used most effectively in thin-walled spherical tanks.

The disclosed invention can also be employed with storage tanks of a drop-shaped or ovoid construction or any other type of a body of revolution with a curvilinear generatrix.

PRIOR ART DEVICE AND ITS DISADVANTAGES

Known in the prior art are liquid storage tanks with an ovoid shell mounted on uprights. The shell points down with its narrower portion and is connected with the supports at the point of the largest cross section.

The disadvantages of the prior art tanks for storage of large amounts of liquids is that to ensure an optimum rigidity and stability on the support, the tank walls should be sufficiently thick and the support should be sufficiently solid and fixed rigidly to the shell.

This increases the weight of the entire structure and, what is most important, complicates its manufacturing process which includes press forging of the tank segments which is difficult owing to their considerable thickness.

Besides, welding of the support around the entire perimeter to the tank shell brings about structural changes in the tank walls which has an adverse effect in service.

Another disadvantage consists in the difficulties of slinging the tank during transportation owing to complexity of its shape.

The above-described storage tanks are characterized by a large metal content, complicated manufacture and difficult transportation.

OBJECTS AND BRIEF DESCRIPTION OF THE INVENTION

An object of the present invention is to provide a storage tank whose structure at a comparatively small metal content and light weight would retain its shape both in service (in the course of filling and liquid storage) and during installation and transportation.

Another object of the present invention resides in equalizing the stresses in the thin walls of the tank.

Still another object of the present invention resides in ensuring easy installation and transportation of the tank.

In accordance with these and other objects we hereby claim a storage tank wherein a shell is made in the form of a body of revolution is mounted on supporting uprights and, according to the invention, the shell is provided with guides equispaced around its external surface along the generatrix, said guides accommodating flexible elements whose upper and lower ends are attached to tensioning devices located on the top and bottom of the tank shell.

It is expedient that the flexible elements should be connected in the middle with the supporting uprights.

Such a connection of the flexible elements with the supporting uprights relieves completely the internal stresses imposed on the thin walls of the tank shell.

It is no less expedient that each tensioning device should comprise a flexible ring with the ends of the flexible elements connected thereto, and a mechanism for changing the length of said flexible ring.

The arrangement of the tensioning device is simplest from the standpoint of design and permits the tension of the flexible elements to be changed comparatively easily and uniformly.

It is possible to attach slings to the flexible ring of the upper tensioning device.

This allows the tank to be prepared for transportation with the aid of a crane or any other known hoisting mechanism.

A storage tank realized according to the present invention has comparatively thin walls of the shell and still is simple to manufacture, handy in service, installation and transportation.

BRIEF DESCRIPTION OF THE DRAWINGS

Now the invention will be described in detail by way of example with reference to the accompanying drawings, in which FIG. 1 is a general view of the storage tank according to the invention;

FIG. 2—same, top view;

FIG. 3 is a section taken along line III—III in FIG. 1, enlarged;

FIG. 4 is a section taken long line IV—IV in FIG. 1, enlarged;

DETAILED DESCRIPTION OF AN EMBODIMENT OF THE INVENTION

The actual embodiment of the invention is described hereinbelow by an example of a spherical storage tank.

The tank comprises a thin-walled shell 1 (FIGS. 1 and 2) mounted on supporting uprights 2 (FIG. 1) the lower ends of all three beams of each of the uprights 2 are fastened to the common base member 16.

To impart the required rigidity to the tank both during liquid storage and during transportation, the thin-walled shell 1 is provided with guides equispaced around its external surface and in the given example is constituted by troughs 3 (FIG. 3). The troughs can be produced by rolling the segments from which the shell 1 is made and serve as its stiffener ribs.

The troughs can be made separately and connected to the shell rigidly by welding or by any other conventional method.

Each trough 3 accommodates a flexible element 4 constituted in the given example by a rope.

The upper ends of the flexible elements 4 are attached to the tensioning device 5 (FIGS. 1, 2) located on the top of the shell 1. The lower ends of the flexible elements 4 are attached to the tensioning device 6 (FIG. 1) located on the bottom of the shell 1.

Each tensioning device 5 and 6 comprises a flexible ring 7 and mechanisms 8 for changing its length. The ends of the flexible elements 4 are connected with the flexible ring 7 by any conventional method suitable for the purpose.

The mechanism 8 for changing the length of the flexible ring 7 may have the form of a turnbuckle or any other known mechanism suited to the purpose.

The tensioning devices may also be of another type, provided they satisfy the requirements stated above.

For gripping the storage tank during transportation, slings 9 are attached to the flexible ring of the tensioning device 5, the other ends of said slings being attached to the ring 10.

Each flexible element 4 (rope) is attached to a corresponding supporting upright 2 by means of a thimble 11 placed between upper and lower bosses 12*a* and 12*b* respectively, said bosses being threaded onto the upper end 2*b* of the supporting upright 2.

As best seen in FIG. 4, the thimble 11 is spliced at its ends into the flexible element or rope 4.

The bosses 12*a* and 12*b* comprise nuts, with the lower boss 12*b* serving as a support for the thimble 11, and the upper boss 12*a* retaining the thimble 11 on the upper end of the supporting upright 2.

The storage tank is made ready for service as follows.

Flexible elements 4 are placed into the guide troughs 3 of the thin-walled tank shell 1 made up of individual segments 2–5 mm thick.

The ends of the flexible elements are shaped into rings through which the flexible rings 7 are passed. The flexible elements 4 are tensioned by the mechanism 8 which changes the length of the flexible ring 7.

Depending on the rated pressure of the liquid to be stored in the tank according to the invention, the flexible elements 4 enveloping the spherical shell 1 are tensioned by means of the tensioning devices 5 and 6, applying equal forces to the elements 4 so that the latter are subjected to identical stresses.

The rigidity of the thin-walled tank assembled in this manner is determined by the rigidity of its shell 1 and the degree of tensioning of the prestressed flexible elements 4.

Then the tank is connected with the supporting uprights.

For this purpose the threaded ends of the supporting uprights 2 are passed through the loop or ring members 11 fixed on the flexible elements 4 and fixed by the nuts 12*a* and 12*b* . In this way the supporting uprights 2 are connected with the flexible elements 4 of the tank. The fact that the supporting uprights 2 of the tank are fixed not on its thin-walled shell 1 but on the prestressed flexible elements 4 fitted around the shell 1 relieves completely the thin walls of the shell of internal stresses which exerts a positive effect during the tank service.

The tank is ready for use.

The supporting uprights 2 connected to the flexible elements 4 of the tank along its equatorial line divide the zone of action of the upper and lower tensioning devices 5 and 6.

If the flexible elements 4 become slack in service which leads to loss of rigidity, said elements 4 should be tightened either individually or all at the same time by means of tensioning devices 5 and 6.

Preparation of the tank for transportation consists in that the slings 9 are attached to the upper flexible ring 7 and passed through the ring 10 which is gripped by a load-hoisting mechanism (not shown), e.g. a crane hook of some other suitable mechanism.

For transportation the tank is lifted together with the supporting uprights 2 as an integral unit.

For this purpose the crane hook (not shown in the drawing) is inserted into the ring 10 at the termination of the slings 9 which are inserted through the flexible ring 7 of the upper tensioning device 5.

In combination with the prestressed flexible elements 4, the walls of the tank shell 1 may be made sufficiently thin.

The small thickness of the walls of the spherical shell simplifies the manufacture of the tank shell as a whole.

The claimed spherical tank for the storage of liquids is extremely simple in manufacture and, therefore, very cheap.

This tank is durable, not distorted in service and easily conveyed because it can be readily slung for carriage by helicopters over roadless country and in deserts.

I claim:

1. A storage tank comprising: a thin-walled shell in the form of a plurality of segments comprising a body of revolution; supporting uprights on which said shell is mounted; guides equispaced around the external surface of said shell, along its generatrix; flexible elements mounted in said guides and secured to said supporting uprights; tensioning devices mounted on the top and bottom of said shell; one end of each of said flexible elements being attached to one of said tensioning devices; and the other end of each of said flexible elements being attached to the other of said tensioning devices.

2. A storage tank according to claim 1 wherein the flexible elements are mounted in the middle to the supporting uprights.

3. A storage tank according to claim 1 wherein each tensioning device comprises a flexible ring with the ends of the flexible elements attached thereto, and a mechanism for changing the length of the flexible ring.

4. A storage tank according to claim 3 wherein there are slings attached to the flexible ring of the upper tensioning device.

* * * * *